US006753802B1

(12) United States Patent
Heydlauff et al.

(10) Patent No.: US 6,753,802 B1
(45) Date of Patent: Jun. 22, 2004

(54) NULL FILTER

(75) Inventors: Bruce M. Heydlauff, Ridgecrest, CA (US); Ralph K. Beyer, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 1826 days.

(21) Appl. No.: 06/820,393

(22) Filed: Oct. 29, 1985

(51) Int. Cl.[7] ..... G01S 13/66

(52) U.S. Cl. ..... 342/62; 342/13; 342/137; 342/149

(58) Field of Search ..... 342/62, 417, 420, 342/424, 427, 147, 149, 68, 13, 20; 244/3.19, 3.14

(56) References Cited

U.S. PATENT DOCUMENTS

| | | | | | |
|---|---|---|---|---|---|
| 3,579,239 | A | * | 5/1971 | Purcell, Jr. | 392/62 |
| 3,708,139 | A | * | 1/1973 | Wheeler | 244/3.13 |
| 3,725,935 | A | * | 4/1973 | Alpers | 342/62 X |
| 3,772,695 | A | * | 11/1973 | Hoffman | 342/149 X |
| 3,890,617 | A | * | 6/1975 | Moulton | 342/149 X |
| 3,949,955 | A | * | 4/1976 | Sykes et al. | 342/62 X |
| 4,047,678 | A | * | 9/1977 | Miller et al. | 244/3.16 |
| 4,075,703 | A | | 2/1978 | Dillard | 343/7 A |
| 4,136,343 | A | * | 1/1979 | Heffner et al. | 342/62 X |
| 4,184,154 | A | * | 1/1980 | Albanese et al. | 342/107 |
| 4,190,837 | A | * | 2/1980 | Salvaudon et al. | 342/62 X |
| 4,231,533 | A | * | 11/1980 | Durig | 244/3.16 |
| 4,241,889 | A | | 12/1980 | Schwellinger et al. | 244/3.15 |
| 4,256,275 | A | | 3/1981 | Flick et al. | 244/3.19 |
| 4,281,889 | A | | 8/1981 | Noguchi | 244/3.19 |
| 4,290,066 | A | * | 9/1981 | Butler | 342/100 |
| 4,366,483 | A | * | 12/1982 | Hagedon et al. | 342/149 X |
| 4,456,862 | A | * | 6/1984 | Yueh | 318/561 |
| 4,492,202 | A | | 1/1985 | Muramatsu et al. | 244/3.15 |
| 4,492,352 | A | | 1/1985 | Yueh | 244/3.15 |
| 4,500,051 | A | * | 2/1985 | Cottle et al. | 244/3.16 |
| 4,502,650 | A | * | 3/1985 | Yueh | 244/3.15 |

FOREIGN PATENT DOCUMENTS

| | | | | |
|---|---|---|---|---|
| GB | 2151428 | * | 7/1985 | 342/424 |

* cited by examiner

*Primary Examiner*—John B. Sotomayor
(74) *Attorney, Agent, or Firm*—Thomas W. Hennen; W. Thom Skeer; Laura R. Foster

(57) ABSTRACT

An electronic circuit for use in an anti-radiation missile system of the type which uses the electromagnetic transmissions of a target radar for guidance information, detects when the missile has flown into a target null and is no longer receiving energy from one of the main lobes or side lobes of the target radar transmitter. When this condition is detected, the circuit causes an attenuation in the epsilon error guidance signal to momentarily prevent guidance commands based upon the now suspect epsilon error signals from being implemented.

5 Claims, 5 Drawing Sheets

NULL FILTER

BACKGROUND OF THE INVENTION

1. Field of the Invention

This invention pertains to the field of electronics and in particular to the field of digital electronics. With greater particularity, this invention pertains to the field of digital signal processing. With greatest particularity, the present invention pertains to a null filter circuit for digital signal processing to prevent erroneous guidance commands in an anti-radiation guided missile (ARM).

2. Description of the Related Art

Anti-radiation missiles are generally passive tracking devices, relying on the radio frequency (RF) energy emitted from a target to generate tracking signals, zeroing out angle errors, and following this energy path to a point of impact upon the target. Radiating targets of interest usually have highly directional energy density patterns in order to achieve small angular resolution for their target tracking purposes.

This is accomplished by focusing the energy with an antenna into a main beam. The focusing process is not perfect, generating lower power density beams known as sidelobes and backlobes which vary in energy density, solid angle, and angular position from the center of the main beam. Included in this beam structure are angular areas where very small amounts of energy are radiated out from the target, known as nulls.

These nulls present a warped phase front which makes the target appear to be emanating from a different position than it's actual location, and they also allow the ARM to receive signals off surrounding objects (multipath) making the target appear to be in a different location. The missile signal processing may then generate erroneous guidance information steering the missile away from the intended target, causing a miss.

SUMMARY OF THE INVENTION

The problem of erroneous missile guidance caused when an anti-radiation missile, which passively tracks radiation emission from a target, encounters a target null, has been solved by the present invention which detects when a null condition exists and momentarily attenuates the guidance error signal so that no guidance commands are issued during the time the null is present.

The invention includes an analog differencing circuit, a comparator, a one-shot multivibrator, a D flip-flop, a clock circuit (variable), three three-input NAND gates, an up/down counter, a multiplying digital to analog converter, two four-input NAND gates, four digital inverters, and an analog output buffering circuit.

Signal inputs include the automatic gain control (AGC) voltage which represents the average power level of the energy received from the target, and the guidance error signal epsilon from which all control commands are generated. The output is a modified epsilon signal which is attenuated when a null is detected, removing the erroneous guidance commands.

The null filter is designed to use the physical property of increasing signal power level as the missile approaches the target. If the received power level begins to drop, and does so at a rapid rate, a target anomaly or null has probably been encountered. By detecting this drop in power level, action may be taken to remove the bad tracking data from the guidance commands allowing the missile to coast, until good tracking data is again received.

BRIEF DESCRIPTION OF THE DRAWING

The invention will be better understood when the detailed description which follows is studied in conjunction with the appended drawing figures, wherein.

DETAILED DESCRIPTION OF THE PREFERRED EMBODIMENT

Figure 1:
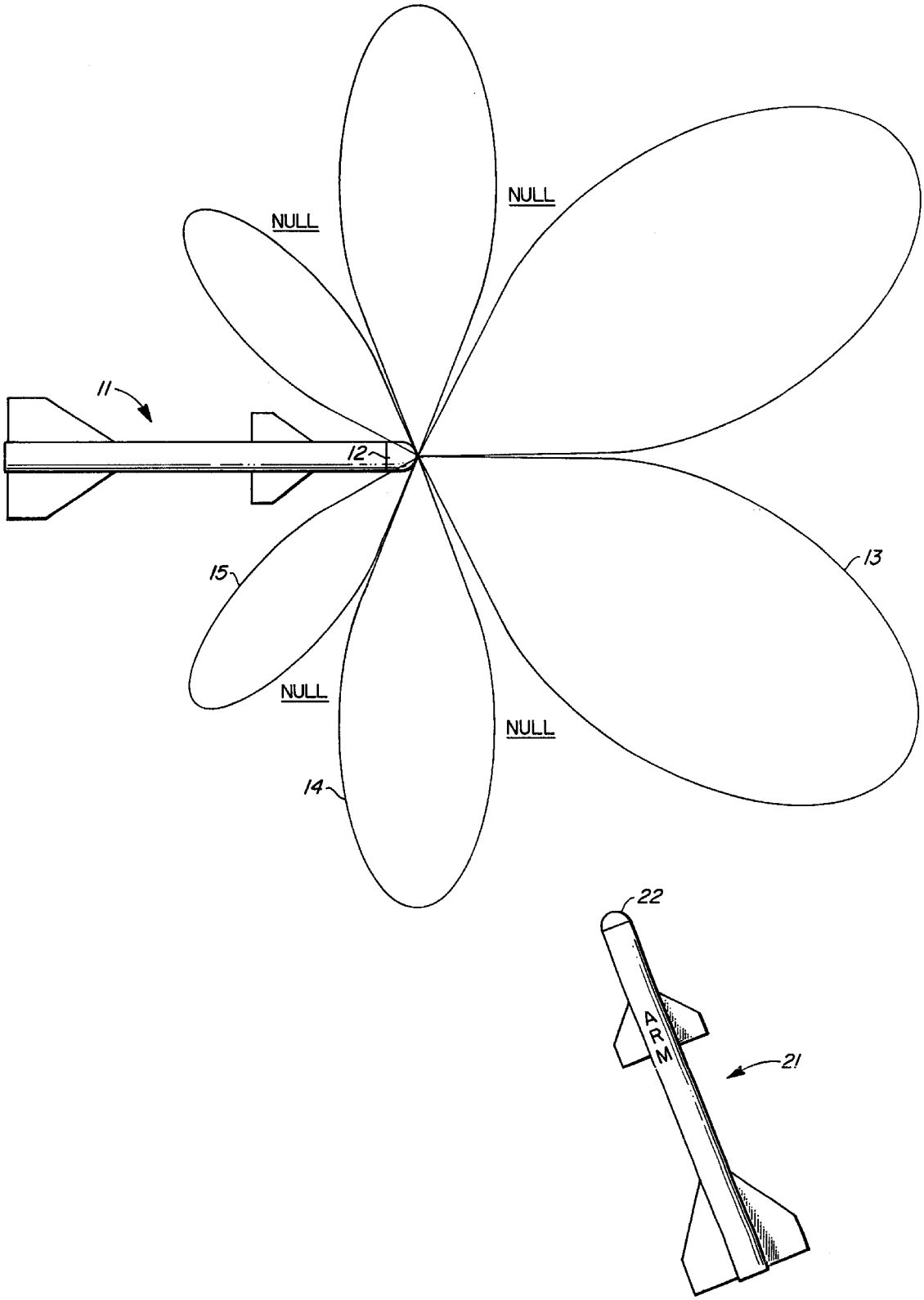
FIG. 1 illustrates an ARM encountering a target null.

Referring now to the drawing figures wherein like parts and elements are represented by like reference characters throughout the several figures, and referring in particular to FIG. 1, there is shown target missile 11 having active radar guidance electronics 12 which produce mainlobe 13, sidelobe 14 and backlobe 15. Between the respective lobes are areas of low signal strength termed nulls. FIG. 1 further illustrates an anti-radiation missile (ARM) 21 which has passive radiant energy guidance electronics 22. ARM 21 is shown intercepting target missile 11.

As can be seen from the schematic representation of FIG. 1, ARM 21 may encounter the main or sidelobe of target missile 11 or may be in a null at different times during the flight. Guidance commands tending to steer ARM 21 toward target missile 11 based upon the signal strength of mainlobe 13 could be confused and disrupted when ARM 21 encounters a null.

Figure 2:
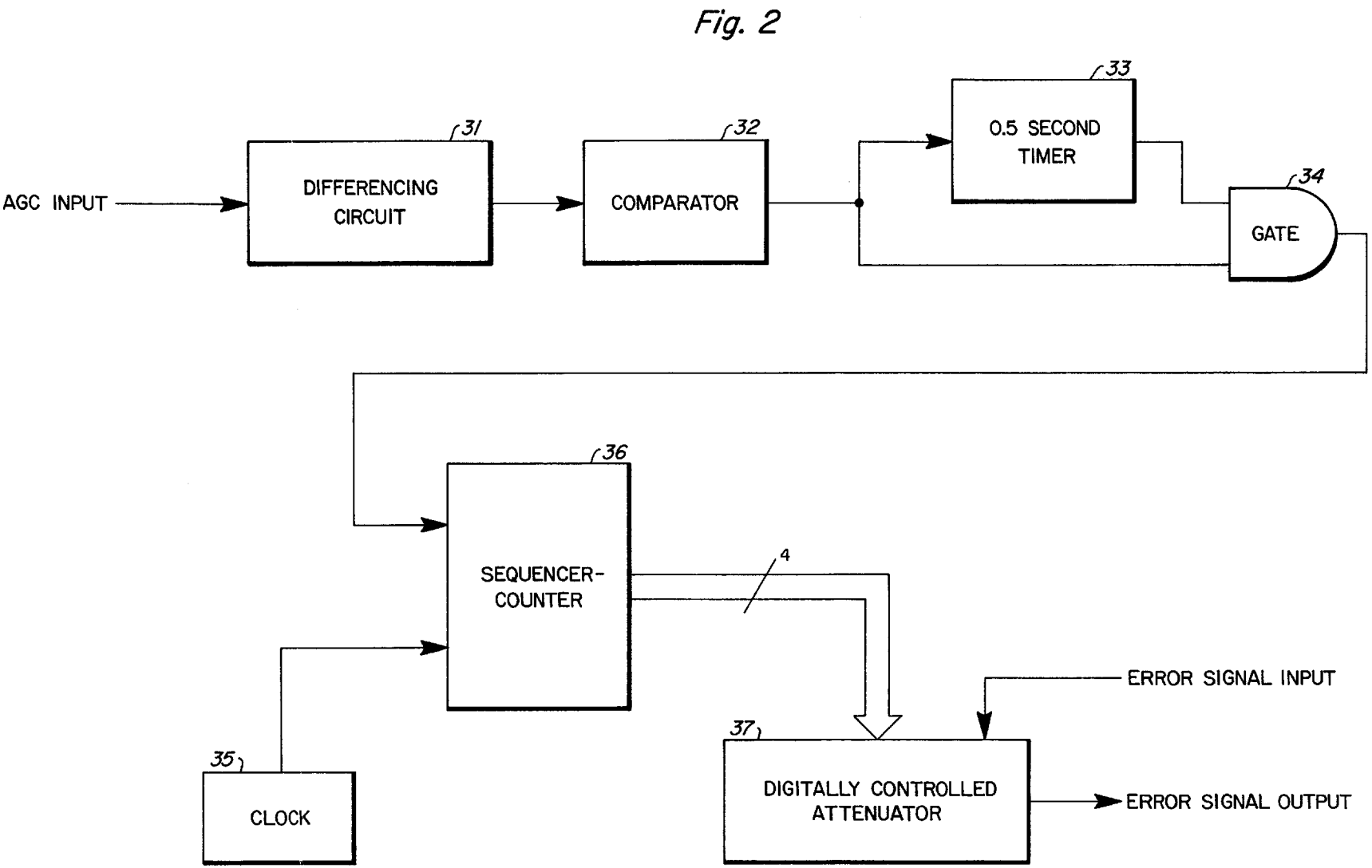
FIG. 2 illustrates a block diagram of a null filter according to the invention.
Figure 3A:
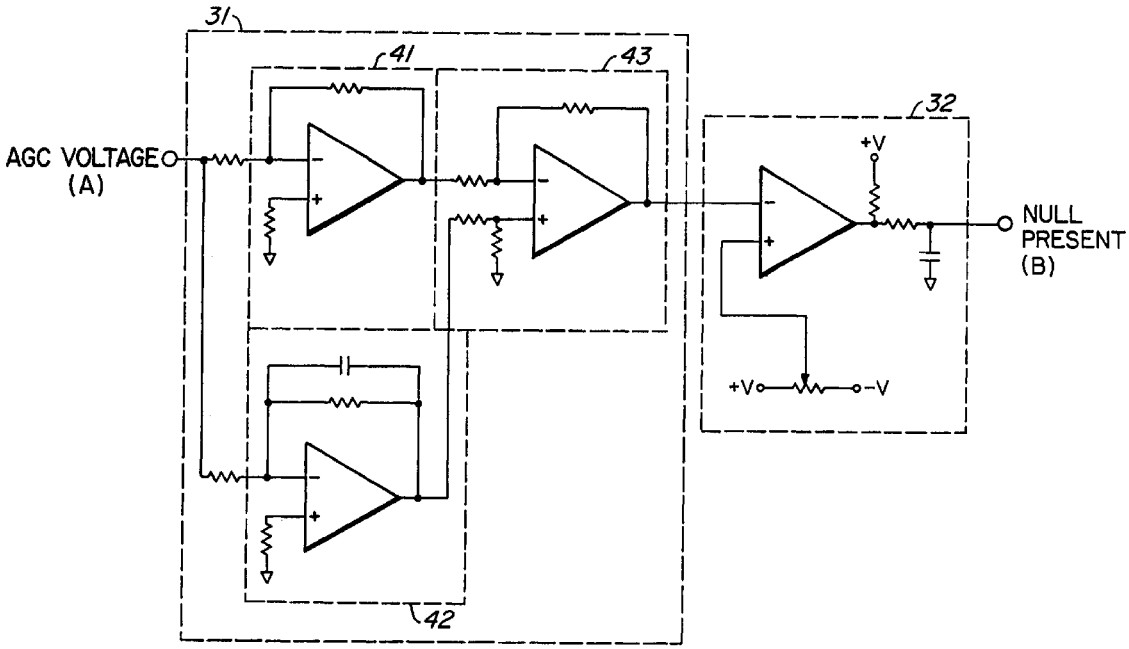
FIG. 3 illustrates a circuit diagram of a null filter according to the invention.
Figure 3B:
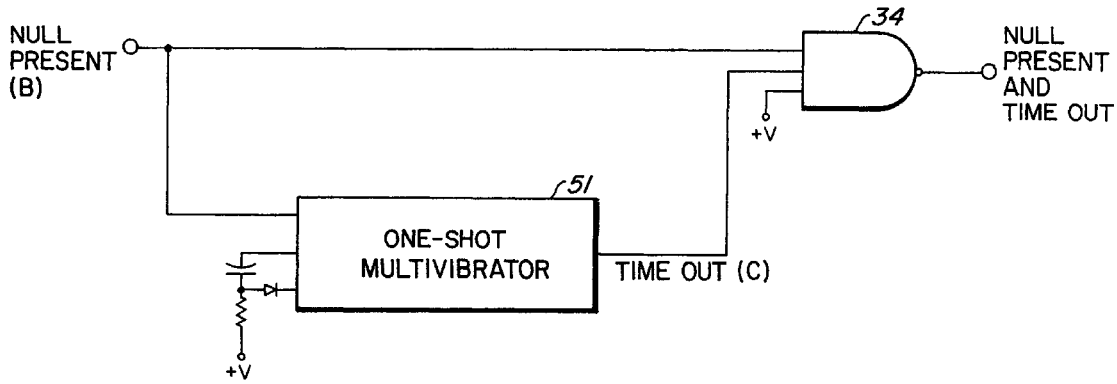
Figure 3C:
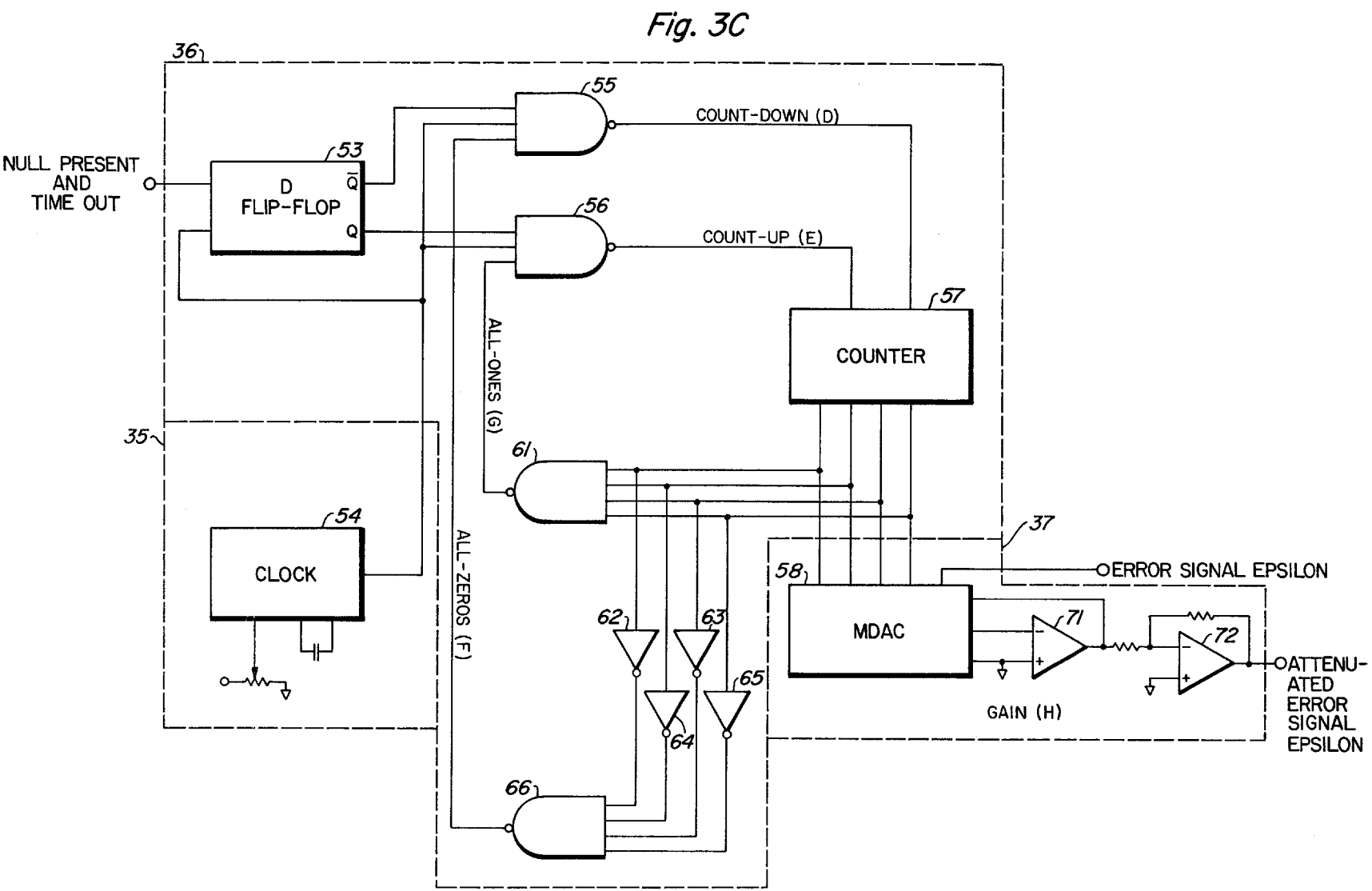

Referring now to FIG. 2, there is shown a block diagram of a null filter according to the present invention. The null filter circuit can be seen to comprise a differencing circuit 31, a comparator 32, a 0.5 second timer 33, a gate 34, a clock 35, a sequencer-counter 36, and a digitally controlled attenuator 37.

Operation of the circuit is as follows. The AGC voltage is differenced with a narrower bandwidth voltage of the AGC to determine the rate of change of the received power level. This is done in the differencing circuit 31 by dividing the AGC voltage into two paths, inverting the voltage in one path with a standard operational amplifier inverting configuration 41, and inverting and filtering the voltage in the other path with a single pole low pass filter 42. The output from one operational amplifier is then subtracted from the other using an operational amplifier configured as a differencing amplifier 43. The output of this amplifier is thus the difference between the present target signal power level and a long time average of this power level.

This output voltage is directed to a comparator 32 which is biased to enable when the AGC difference voltage has dropped an equivalent of a 3 dB drop in received power from the target. This is the process by which the null is detected and flagged to the rest of the circuitry, which removes the guidance commands.

When the output of the comparator is enabled, it indicates a "Null Present". The enable signal triggers a one-shot multivibrator 51 which is set to produce a 0.5 second output pulse. This is a "time-out override" of the null present enable, used to make sure the missile doesn't fly without guidance for any longer than 0.5 seconds. The null present enable and the time-out override are gated together with a NAND gate 34 such that whichever signal disables first, takes precedence and signals the end of the event.

The null present (logical) and time-out signal is routed to a D flip-flop 53 where it is synchronized to a clock 54. Outputs from the D flip-flop 53 (true and complement of the signal null present (logical) and time-out) are directed to respective inputs of two three-input NAND gates 55 and 56. These two NAND gates 55 and 56 provide the clocking signals to a 4 bit up/down counter 57 depending on the status of the system. Outputs from counter 57 drive the 4 most significant bits of a multiplying digital to analog converter 58 (MDAC) which is configured as a digitally controlled analog attenuator. The counter 57 outputs are also directed to the inputs of a four-input NAND gate 61, and a set of logical inverters 62,63,64 and 65. Output from NAND gate 61 indicates when the counter has reached a count of 15, or all four outputs are high. This logical signal is fed to the input of NAND gate 56 which disables the count-up clock signal directed to counter 57. The outputs from the inverters 62, 63, 64 and 65 are routed to a four-input NAND gate-66 and its output indicates when counter 57 has reached zero, all outputs low. This signals the NAND gate 66 to disable the count-down clock signal to the counter 57. All this circuitry provides the means to control the amplitude of the error signal epsilon.

When a null is detected, and assuming the counter 57 outputs are all ones, NAND gate 55 will enable the count down clock to the counter 57. As the count decreases, the attenuation of epsilon increases, until the count equals zero a n d the count down clock 57 is disabled. This is a stable state as long as the null is present and the 0.5 second time-out has not occurred. When the null is no longer present, the count down clock stays disabled and the count up clock is enabled via NAND gate 56. The counter 57 begins to increment, attenuation of epsilon decreases until the count reaches all ones and the count up clock is disabled. This is also a stable state, where epsilon is not attenuated, and a null is not present. The operational amplifiers 71 and 72 on the output of the MDAC 58 are needed to buffer and invert epsilon for output to the missile guidance electronics.

Figure 4:
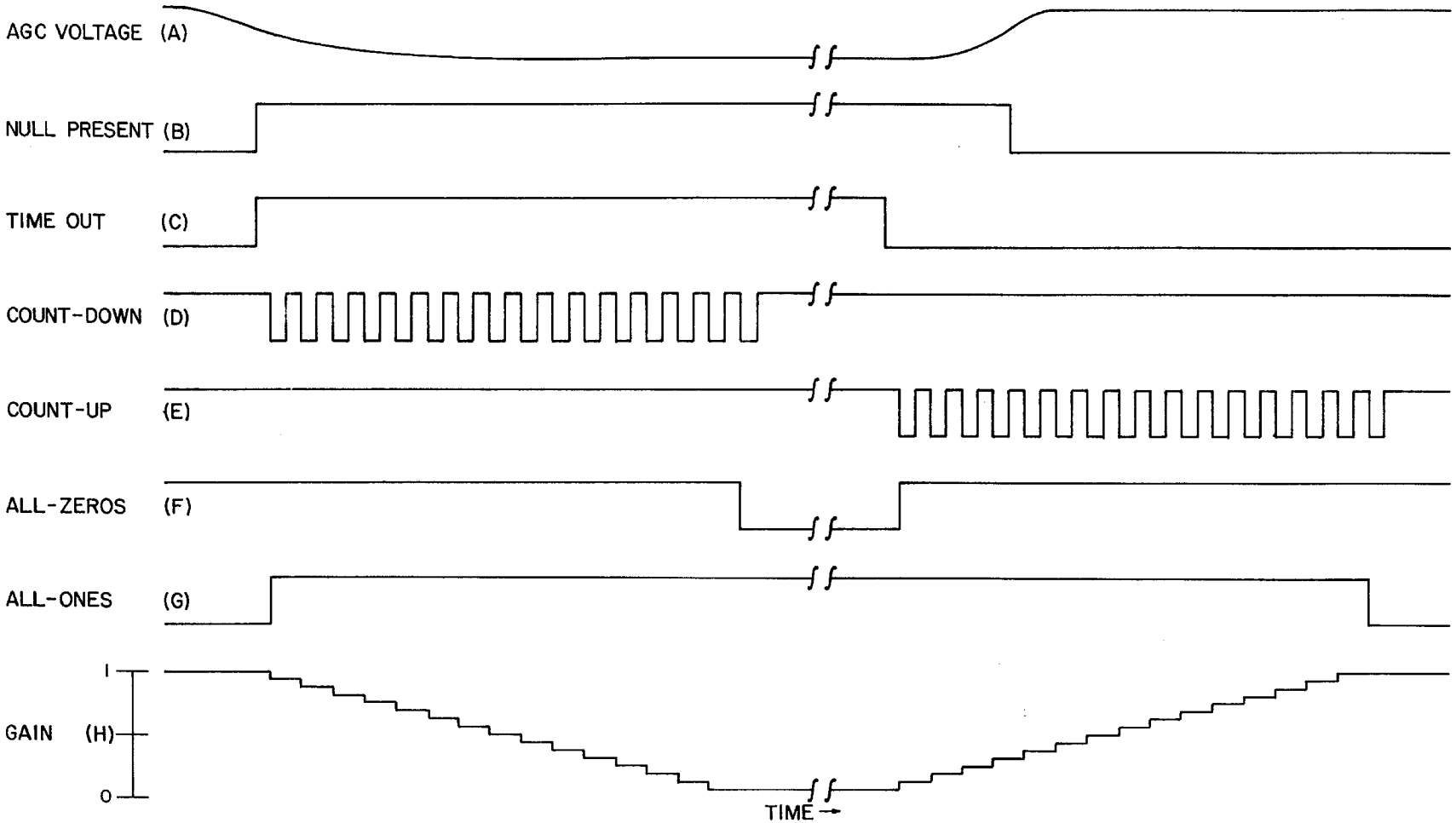
FIG. 4 illustrates typical signals present in the circuitry during operation of the invention.

FIG. 4 illustrates typical signals from various portions of the circuitry. AGC voltage (A) represents the voltage proportional to the received signal strength from the target missile at the input to differencing circuit 31. Null present signal (B) illustrates the output of comparator 32 when a null signal has been encountered. Time-out signal (C) illustrates the output of one-shot 51 when a null has been encountered. Count-down signal (D) illustrates the output from NAND gate 55 when a null has been encountered. Count-up signal (E) illustrates the output from NAND gate 56 after NAND gate 55 has counted down. All zeros signal (F) illustrates the output from NAND gate 66 which disables NAND gate 55. All ones signal (G) illustrates the output from NAND gate 61 which disables NAND gate 56. Finally, FIG. 4 shows the attenuation of gain which operates on the epsilon error guidance signal to gradually remove the error signal and then gradually replace it after a predetermined period of time.

This method provides a means to detect and remove the adverse effects of flying an ARM missile into a target null. The integrated circuits which have been used to advantage in the present invention are common components available from commercial sources. The following table lists the components as described in this description and the circuit numbers of corresponding commercial products which are representative of workable circuit components.

TABLE I

| | | |
|---|---|---|
| Operational amplifier | 41 | TL084 |
| Operational amplifier | 42 | TL084 |
| Operational amplifier | 43 | TL084 |
| Comparator | 32 | LM111 |
| One-shot multivibrator | 51 | 26L02 |
| NAND gate | 34 | 74LS10 |
| D flip-flop | 53 | 74LS74 |
| Clock | 54 | 74LS124 |
| NAND gate | 55 | 74LS10 |
| NAND gate | 56 | 74LS10 |
| Up/Down Counter | 57 | 74LS193 |
| NAND gate | 61 | 74LS20 |
| NAND gate | 66 | 74LS20 |
| Inverters | 62, 63, 64 and 65 | 74LS04 |
| Multiplying Digital to Analog Converter | 58 | AD7524 |
| Operational Amplifier | 71 | TL084 |
| Operational Amplifier | 72 | TL084 |

The invention can and has been implemented using a microprocessor and software to perform the same function, allowing considerably greater flexibility in parameter adjustment. In this particular implementation the AGC voltage is digitized and read into the microprocessor where logic operations are performed to detect a null condition. Attenuation of the error signal epsilon is handled in the same way with an MDAC, but the digital word is output from the microprocessor rather than a counter.

Obviously, many modifications and variations of the present invention are possible in light of the above teachings. It is therefore to be understood that within the scope of the appended claims the invention may be practiced otherwise than as specifically described.

We claim:

1. A null filter for attenuating an epsilon guidance error signal in an anti-radiation missile guidance system in response to encountering a target null signal, and for restoring the epsilon guidance error signal when the target null signal is no longer present, comprising:

null signal means for providing a null present signal in response to a predetermined magnitude decrease in received target signal strength;

timing means electrically connected to said null signal means for generating a time out signal lasting a predetermined period of time following said predetermined magnitude decrease in received target signal strength;

first logical NAND gate means electrically connected to said null signal means and said timing means for providing an output signal in response to a contemporaneous null present signal and time out signal;

sequencing means for providing a countdown signal in response to said first logical NAND gate output signal and a count-up signal in response to the subsequent absence of said first logical NAND gate output signal; and adjustable gain means electrically connected to said sequencing means for operating on the epsilon guidance error signal in response to said countdown signal and said count-up signal to gradually attenuate said epsilon guidance error signal during said countdown signal and to restore said epsilon guidance error signal during said count-up signal.

2. A null filter as set forth in claim 1 wherein said null signal means comprises:

an input for introducing a signal which is proportional to the received energy from the target;

a first inverting operational amplifier electrically connected to said input for outputting a signal proportional to the current target signal strength;

a second inverting operational amplifier including a single pole low pass filter electrically connected to said input for outputting a signal proportional to the long time average target signal strength;

a third differencing operational amplifier connected to said first and second operational amplifiers for subtracting the output of one of said first and second operational amplifiers from the other and outputting the difference; and a fourth comparator operational amplifier electrically connected to said third differencing operational amplifier, which is biased to output an enable signal when the output of the third differencing operational amplifier indicates a 3 dB decrease between the current target signal strength and the long time average target signal strength, thereby indicating the presence of a target null.

3. A null filter as set forth in claim 1 wherein said timing means comprises:

a one-shot multivibrator electrically connected to said null signal means for providing an output pulse of predetermined duration in response to said null signal means indicating that a null signal is present; and a second logical NAND gate electrically connected to said one-shot and to said null signal means for outputting a low signal until said predetermined time after said null signal means indicates a null signal is present, and thereafter outputting a high signal.

4. A null filter as set forth in claim 1 wherein said sequencing means comprises:

a D flip-flop electrically connected to said first logical NAND gate means;

a clock;

a second logical NAND gate electrically connected to said D flip-flop and to said clock;

a third logical NAND gate electrically connected to said D flip-flop and to said clock;

a four bit up/down counter electrically connected to said second and third logical NAND gates;

a fourth logical NAND gate electrically connected to the outputs from said four bit up/down counter and electrically connected to the input of said third logical NAND gate;

a set of logical inverters connected to the outputs of said four bit up/down counter; and a fifth logical NAND gate electrically connected to each of said logical inverters and electrically connected to the input of said second logical NAND gate.

5. A null filter as set forth in claim 4 wherein said adjustable gain means comprises:

a multiplying digital-to-analog converter configured as a digitally controlled analog attenuator electrically connected to the output of said four bit up/down counter;

a fifth operational amplifier electrically connected to said multiplying digital-to-analog converter for use as a buffer and invertor; and a sixth operational amplifier electrically connected into said fifth operational amplifier for buffering and inverting said epsilon guidance error signal.

* * * * *